US009300058B2

(12) United States Patent
Acera

(10) Patent No.: US 9,300,058 B2
(45) Date of Patent: Mar. 29, 2016

(54) ELECTRICAL CONNECTOR WITH A PAIR OF CABLE ARRANGING BASES

(71) Applicant: Amphenol LTW Technology Co., Ltd., New Taipei (TW)

(72) Inventor: Jimmy Enrique Acera, New Taipei (TW)

(73) Assignee: AMPHENOL LTW TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/276,946

(22) Filed: May 13, 2014

(65) Prior Publication Data

US 2015/0214637 A1 Jul. 30, 2015

(30) Foreign Application Priority Data

Jan. 29, 2014 (TW) ..... 103202014 U

(51) Int. Cl.
*H01R 4/24* (2006.01)
*H01R 24/20* (2011.01)

(52) U.S. Cl.
CPC ..... *H01R 4/2429* (2013.01); *H01R 4/2416* (2013.01); *H01R 24/20* (2013.01)

(58) Field of Classification Search
CPC ..... H01R 4/2416; H01R 4/242; H01R 4/2429
USPC ..... 439/395–408
See application file for complete search history.

(56) References Cited

U.S. PATENT DOCUMENTS 4,143,935 A * 3/1979 Goodman et al. ..... 439/405
5,902,146 A * 5/1999 Hanami ..... 439/405
5,947,761 A * 9/1999 Pepe ..... 439/409
5,957,720 A * 9/1999 Boudin ..... 439/417
6,869,306 B1 * 3/2005 Sung ..... 439/449
7,249,979 B2 * 7/2007 Gerber et al. ..... H01R 24/00
7,413,464 B1 * 8/2008 Chen ..... 439/404
7,713,081 B2 * 5/2010 Chen ..... 439/468
7,918,684 B2 * 4/2011 Lu ..... 439/395
8,052,461 B2 * 11/2011 Wang ..... H01R 4/24 439/405
8,215,980 B1 * 7/2012 Lin ..... 439/404
8,573,999 B2 * 11/2013 Feldner et al. ..... H01R 4/24 439/409
2008/0057793 A1 3/2008 Gerber et al.
2010/0317226 A1 * 12/2010 Schmid et al. ..... 439/582
2011/0028047 A1 2/2011 Wang

FOREIGN PATENT DOCUMENTS

EP 1336225 B1 4/2011

OTHER PUBLICATIONS

Search Report dated Jul. 17, 2014 of the corresponding European patent application.

* cited by examiner

*Primary Examiner* — Chandrika Prasad
(74) *Attorney, Agent, or Firm* — Chun-Ming Shih; HDLS IPR Services

(57) ABSTRACT

An electrical connector including an insulation pillar (100), multiple terminals (200) and a cable arranging base (300) is provided in the present disclosure. A cable connecting base (110) is arranged at an end of the insulation pillar (100), the terminals (200) are embedded in the insulation pillar (100), a puncturing tool (210) is provided at an end of each terminal (200), the puncturing tool (210) is extended from the cable connecting base (110) along a radial direction thereof, and the insulation pillar (100) is protruded thereby. The cable arranging base (300) clips the cable connecting base (110) and has multiple insertion slots (310) corresponding to the puncturing tools (210), and each insertion slot (310) is perpendicular with the corresponding puncturing tool (210). Thereby, multiple cables (11) are clipped by the cable arranging base (300) and prepared for electrically connecting to corresponding terminals (200).

9 Claims, 10 Drawing Sheets

ELECTRICAL CONNECTOR WITH A PAIR OF CABLE ARRANGING BASES

BACKGROUND

The present disclosure is related to an electrical connector, particularly a puncturing type electrical connector.

DESCRIPTION OF RELATED ART

A conventional electrical connector is used to be electrically connected to a circuit board or a cable. The electrical connector is used to be connected to the circuit board by welding, and connected to the cable by welding or puncturing. Accordingly, a puncturing tool is formed at an end of each terminal of the electrical connector to puncture an insulation layer of a corresponding conductive wire, and each terminal is thereby connected to the corresponding conductive wire.

While the conventional electrical connector being connected to cables, each cable should be manually aligned to a corresponding puncturing tool of the conventional electrical connector and then the cables are clamped with the puncturing tool by a clamper. Since manual alignment process is not only time consuming but also imprecise, that is a defect of prior technology.

In views of this, in order to solve the above disadvantage, the present inventor studied related technology and provided a reasonable and effective solution in the present disclosure.

SUMMARY

A main purpose of the present disclosure is providing an electrical connector which is easily to be connected with cables.

In order to accomplish the above purpose, an electrical connector including an insulation pillar, multiple terminals and a cable arranging base is provided in the present disclosure. A cable connecting base is arranged at an end of the insulation pillar, the terminals are embedded in the insulation pillar, a puncturing tool is provided at an end of each terminal, the puncturing tool is extended from the cable connecting base along a radial direction thereof, and the insulation pillar is protruded thereby. The cable arranging base is clipping on the cable connecting base and having multiple insertion slots corresponding to the puncturing tools, and each insertion slot is perpendicular with the corresponding puncturing tool. Thereby, multiple cables are clipped on the cable arranging base and prepared for electrically to connecting corresponding terminals.

A pocket hole is preferably defined in the insertion slot and allowed the puncturing tool to be inserted therein.

A cable clipping slot corresponding to each insertion slot is preferably provided on the cable arranging base.

A cable clipping slot corresponding to each insertion slot is preferably provided on the cable arranging base.

A couple of clipping blocks are preferably provided on an internal wall of each cable clipping slot.

Two limiting walls opposite with each other are preferably provided on the cable connecting base, the limiting walls are arranged at interval along an axial direction of the insulation pillar, and the cable arranging base is limited between the two limiting walls.

A plug is preferably formed at the other end of the insulation pillar, a plurality of hole slots corresponding to the terminals are defined on the plug along an axial direction of the plug, the other end of each terminal is inserted in the corresponding hole slots.

The electrical connector of the present disclosure is preferably further included of a cylinder housing, the insulation pillar is covered by the cylinder housing, and a tread is provided on a lateral surface of an end of the cylinder housing.

The cylinder housing is preferably included of a first housing and a second housing hermitically coupled with each other, the plug is covered by the first housing, and the cable connecting base is covered by the second housing The tread is preferably provided on an external surface of the first housing.

A cable connection opening is preferably defined on the second housing.

Each conductive wire can be clipped by the cable arranging base. Thereby, each conductive wire 11 can be easily electrically connected to the corresponding terminal.

DETAILED DESCRIPTION OF EMBODIMENT

Figure 1:
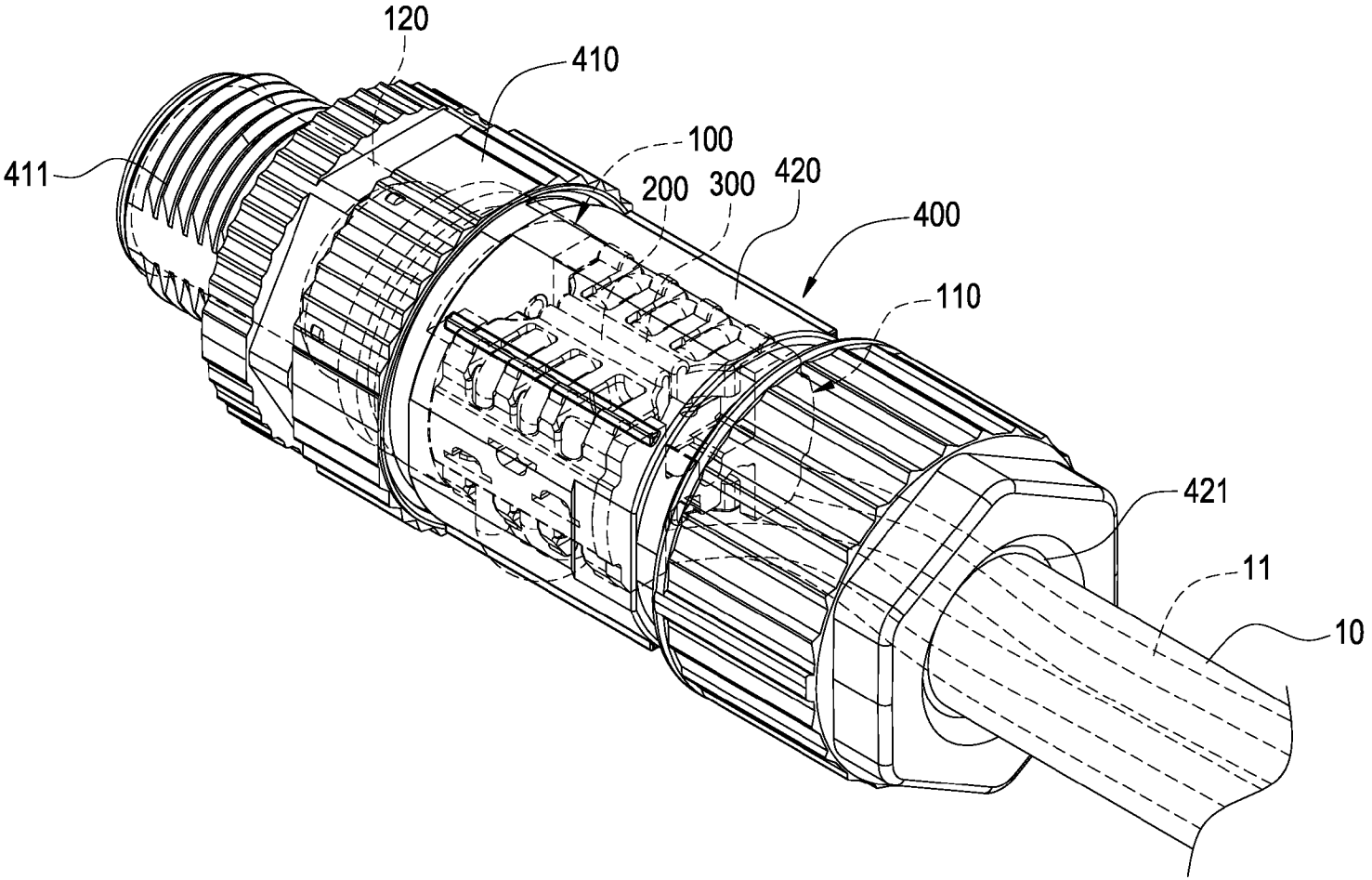
FIG. 1 is a schematic diagram showing the electrical connector of the present disclosure.

Please refer to FIG. 1. An electrical connector including an insulation pillar 100, multiple terminals 200, a cable arranging base 300 and a cylinder housing 400 is provided in an embodiment of the present disclosure.

Figure 2:
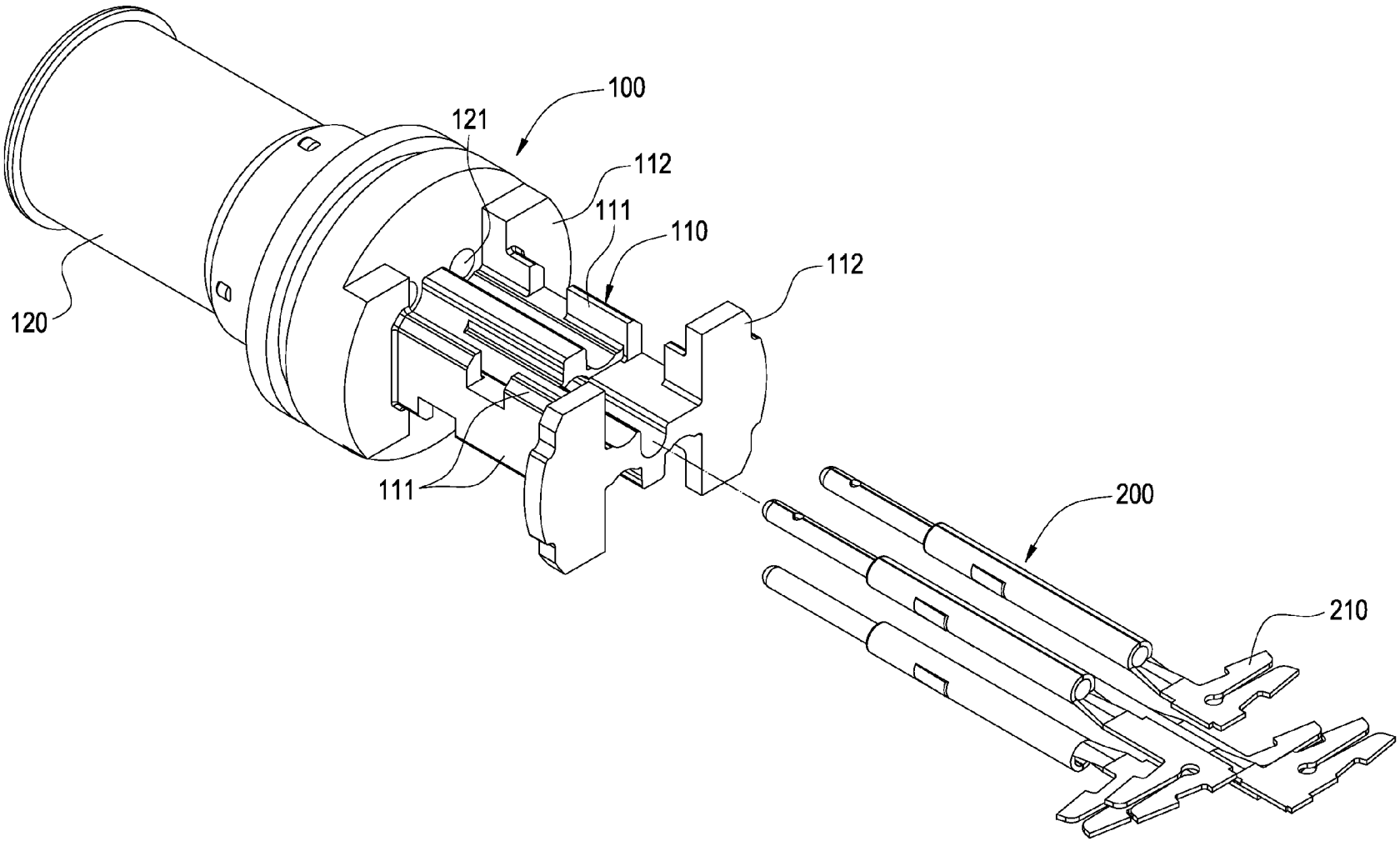
FIG. 2 is a schematic diagram showing the insulation pillar and the terminals of the embodiment of the present disclosure.

Please refer to FIGS. 1 and 2, in the present embodiment, the insulation pillar 100 is preferably a cylinder made of plastic. A cable connecting base 110 is formed at an end of the insulation pillar 100, and a plug 120 is formed at the other end of the insulation pillar 100. The cable connecting base 110 is preferably of a flat pillar shape, and the cable connecting base 110 therefore has a couple of lateral surfaces opposite with each other and a couple of side edges between the lateral surfaces. A limiting wall 112 is formed at each end of the cable connecting base 110, and the limiting walls 112 are arranged at interval along an axial direction of the insulation pillar 100. A couple of stopping ribs 111 are provided on each side edge of the cable connecting base 110, and the two stopping ribs 111 are respectively arranged on the two lateral surfaces of the cable connecting base 110 and opposite with each other. The plug 120 is preferably of a cylinder shape, and a plurality of hole slots 121 are defined on an end surface thereof and along an axial direction thereof. In the present embodiment, six hole slots 121 are preferably defined on the plug 120.

In the present embodiment, the electrical connector of the present disclosure is preferably included of six terminals 200 made of metal. Each terminal 200 is preferably of a pin shape. The terminals 200 are embedded in the insulation pillar 100, and each terminal 200 is arranged corresponding to a hole slot 121. An end of each terminal 200 is of a cylinder shape and inserted in the corresponding hole slot 121. A puncturing tool 210 is extended from the other end of each terminal 200. The puncturing tools 210 are fixed on the two lateral surfaces. Each puncturing tool 210 protrudes the insulation pillar 100 from the side edge of the cable connecting base 110. In the present embodiment, each puncturing tools 210 is preferably of a clamp shape, but this is not a limitation of the present disclosure. In the present embodiment, the puncturing tools 210 are arranged on the cable connecting base 110 as described below. Three puncturing tools 210 are fixed on each lateral surface of the cable connecting base 110, one of the puncturing tool 210 protrudes a side edge of the cable connecting base 110, and the other puncturing tools 210 protrudes the other side edge of the cable connecting base 110. Three puncturing tools 210 are arranged on each side edge.

Figure 3:
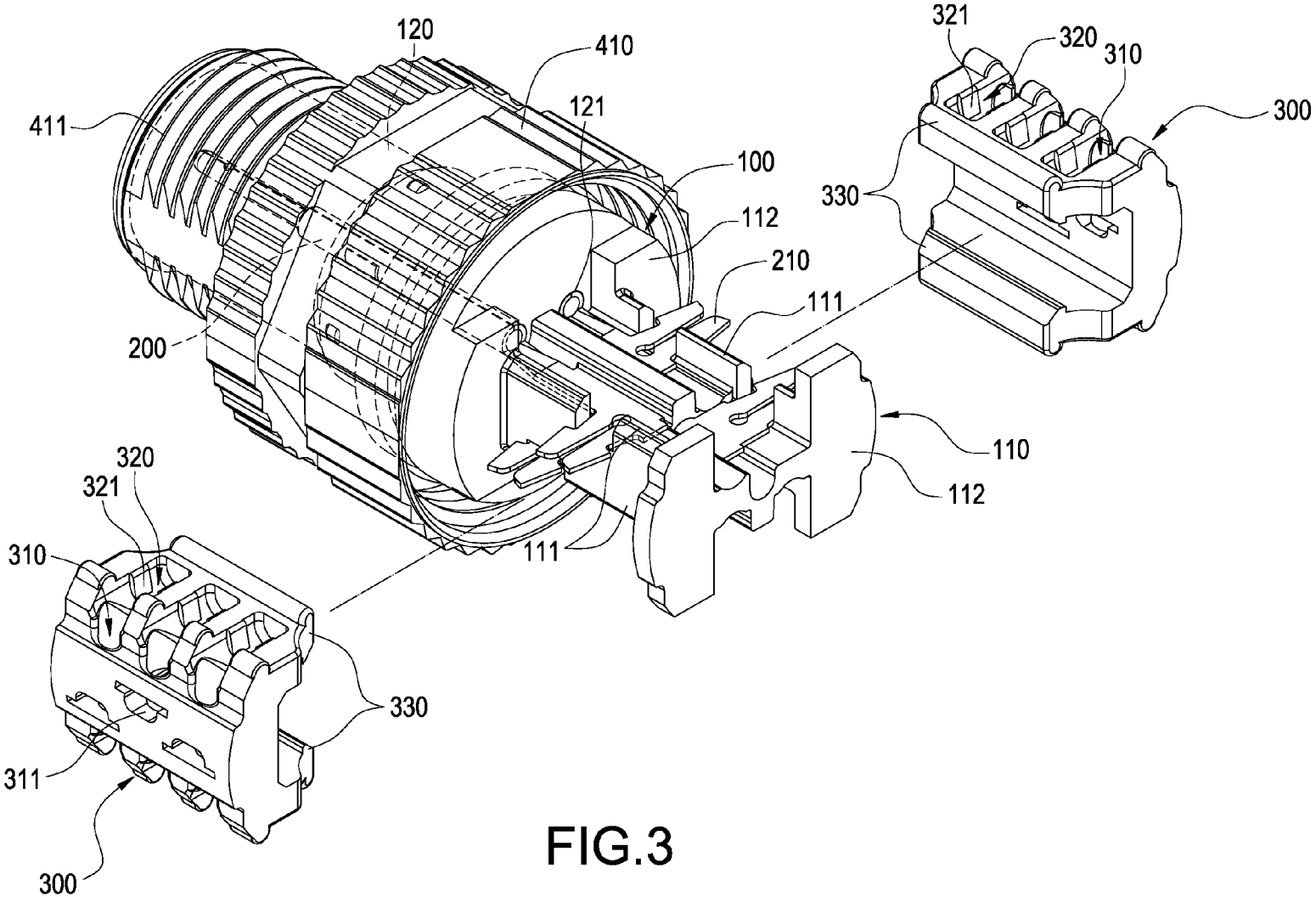
FIG. 3 is an explosion drawing showing the electrical connector of the present disclosure.

Please refer to FIG. 3. In the present embodiment, the electrical connector is included of two cable arranging base 300. Each cable arranging base 300 is movably clamping on the corresponding side edge of the cable connecting base 110 and the cable arranging base 300 is limited between the limiting walls 112. In the present embodiment, each cable arranging base 300 is a pillar with a C-shaped cross section. Thereby, a couple of hooks 330 opposite to each other are formed on each cable arranging base 300. Each hook 330 hooks the corresponding stopping rib 111. Preferably, three insertion slots 310 are defined on each cable arranging base 300, each insertion slot 310 is arranged corresponding to one of the puncturing tools 210, each insertion slot 310 is extended between the two hooks 330, and each insertion slot 310 is perpendicular with the corresponding puncturing tool 210. A pocket hole 311 aligned with the corresponding puncturing tool 210 is defined in each insertion slot 310. The pocket hole 311 is extended to an external surface of the cable arranging base 300. Preferably, three cable clipping slots 320 corresponding to each insertion slot 310 of the cable arranging base 300 is defined on each hook 330 of each cable arranging base 300. Each cable clipping slot 320 is connected to an end of the corresponding insertion slot 310, and a couple of clipping blocks 321 opposite to each other are formed on an internal surface of each cable clipping slot 320.

Please refer to FIGS. 1 and 3. In the present embodiment, the cylinder housing 400 is a hollow cylinder made of metal. The cylinder housing 400 is included of a first housing 410 and a second housing 420 coupled (preferably screwed) with each other along an axial direction of the cylinder housing 400. The plug 120 is coved by the first housing 410, exposed on an end surface of the first housing 410, and allowing coupled with another corresponding connector. A thread 411 is arranged on a lateral surface of the first housing 410 and aligned with the plug 120 to screw connect the corresponding connector. The cable connecting base 110 is covered by second housing 420, and a cable connecting opening 421 is defined on an end surface of the second housing 420.

Please refer to FIG. 1. The electrical connector of the present disclosure is allowed to be inserted a cable 10 therein, the cable 10 is consisted of a cluster of conductive wires 11, and each conductive wire 11 is electrically connected to the corresponding terminal 200. In the present embodiment, the electrical connector of the present disclosure is connected to a cable 10 included of a cluster consisted of seven conductive wires 11. The first housing 410 is separated from the second housing 420 in advance, and then the cable is inserted into the second housing 420 through the cable connecting opening 421.

Figure 4:
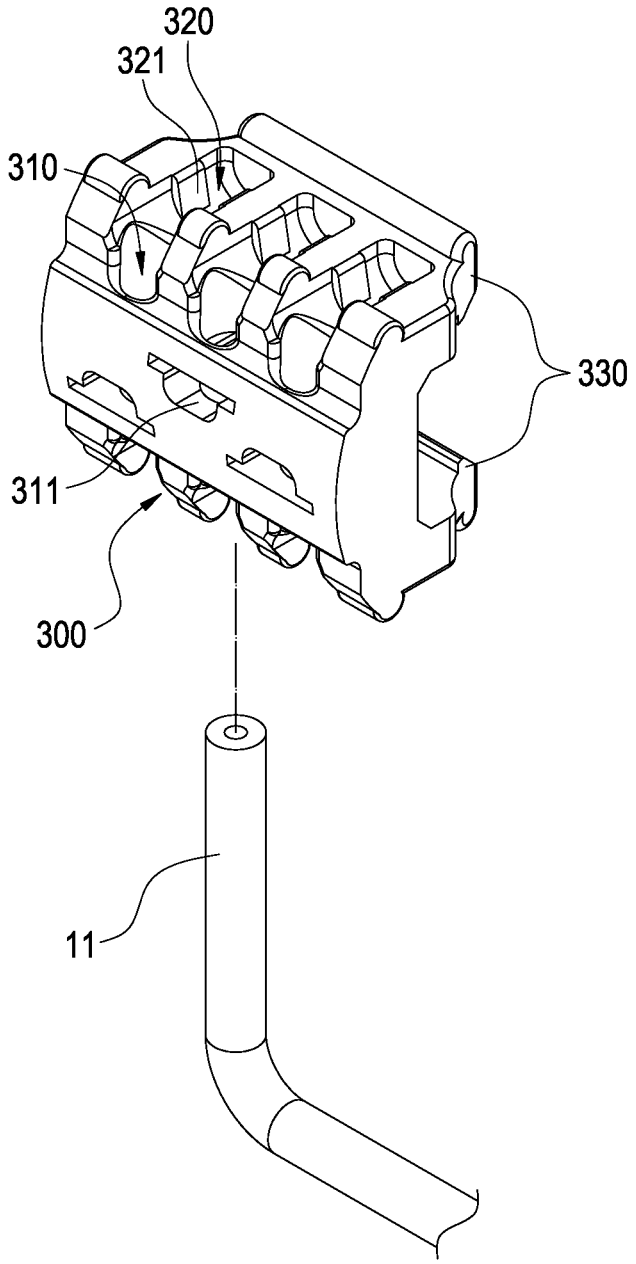
FIG. 4 is a schematic diagram showing the cable arranging base and wires inserted therein.
Figure 5:
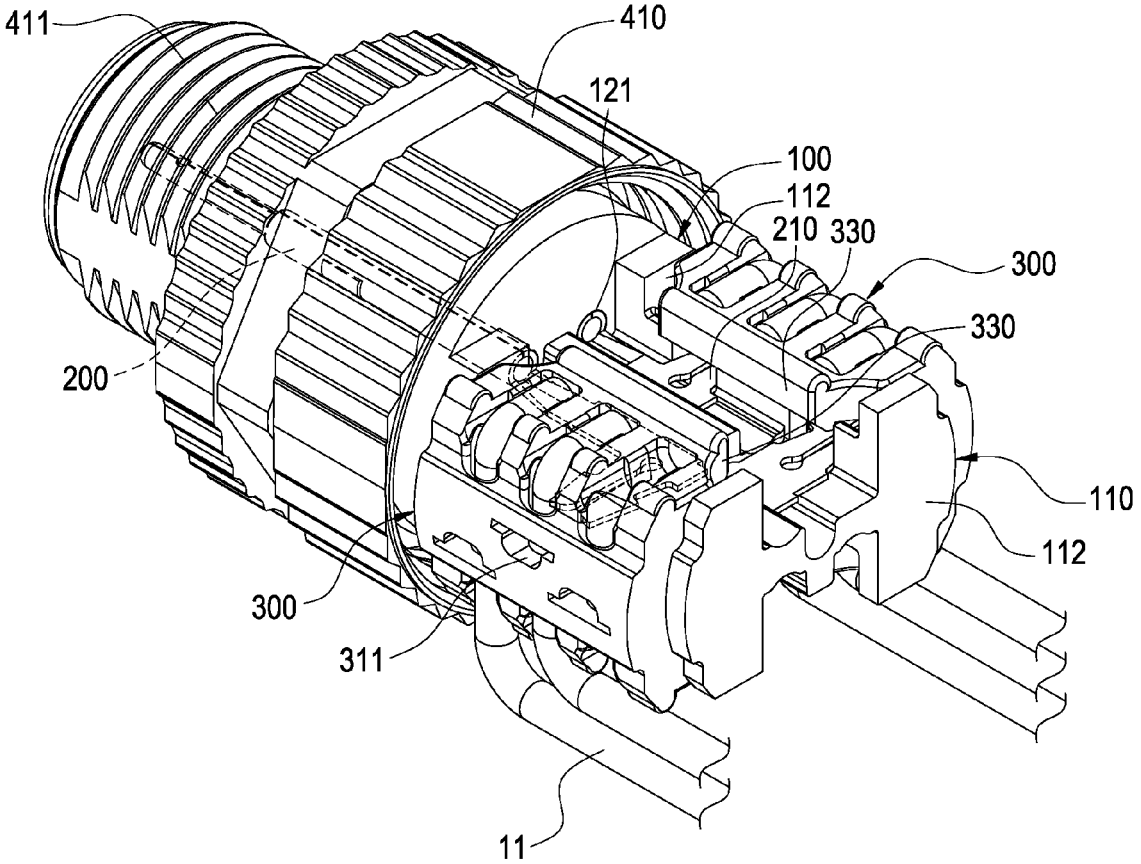
FIG. 5 is a schematic diagram showing the electrical connector and cables inserted therein.
Figure 6:
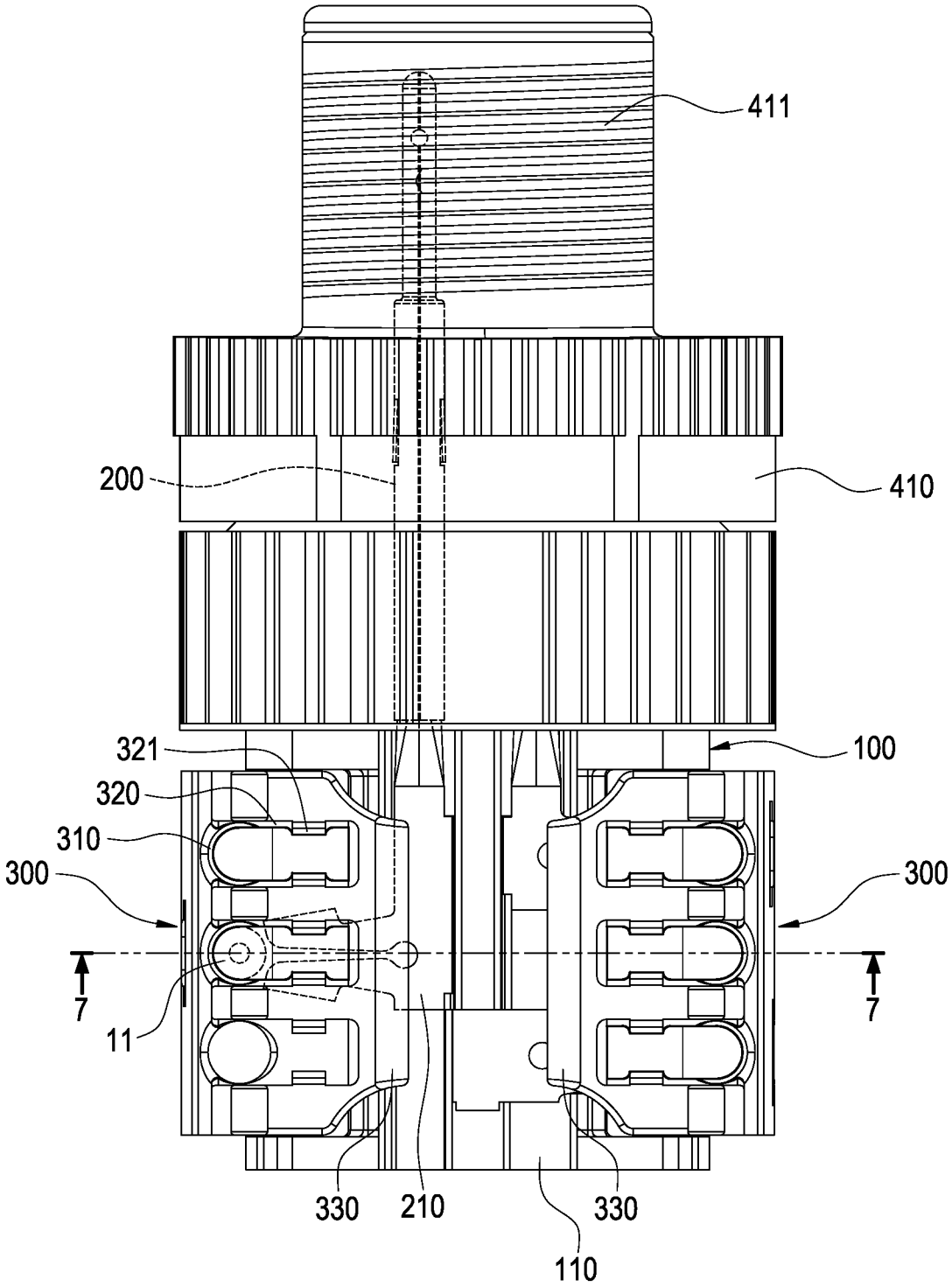
FIG. 6 is another schematic diagram showing the electrical connector and cables inserted therein.
Figure 7:
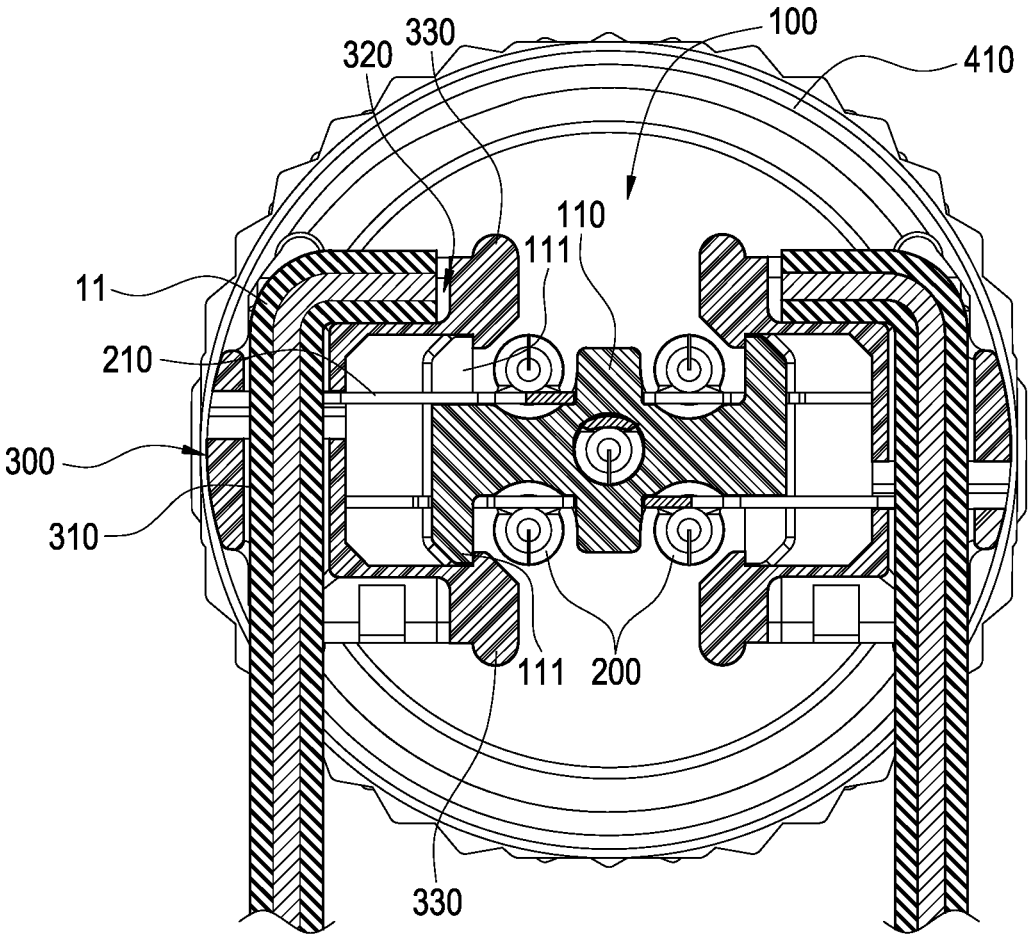
FIG. 7 is a sectional view of the electrical connector shown in FIG. 6.

Please refer to FIG. 4. Each conductive wire 11 is inserted into the corresponding insertion slot 310. Please refer to FIG. 5-7, an end of each conductive wire 11 is bended and arranged in the cable clipping slots 320 connected to the insertion slot 310. The wire 11 is preferably clipped by the two clipping blocks 321 in the cable clipping slots 320.

Figure 8:
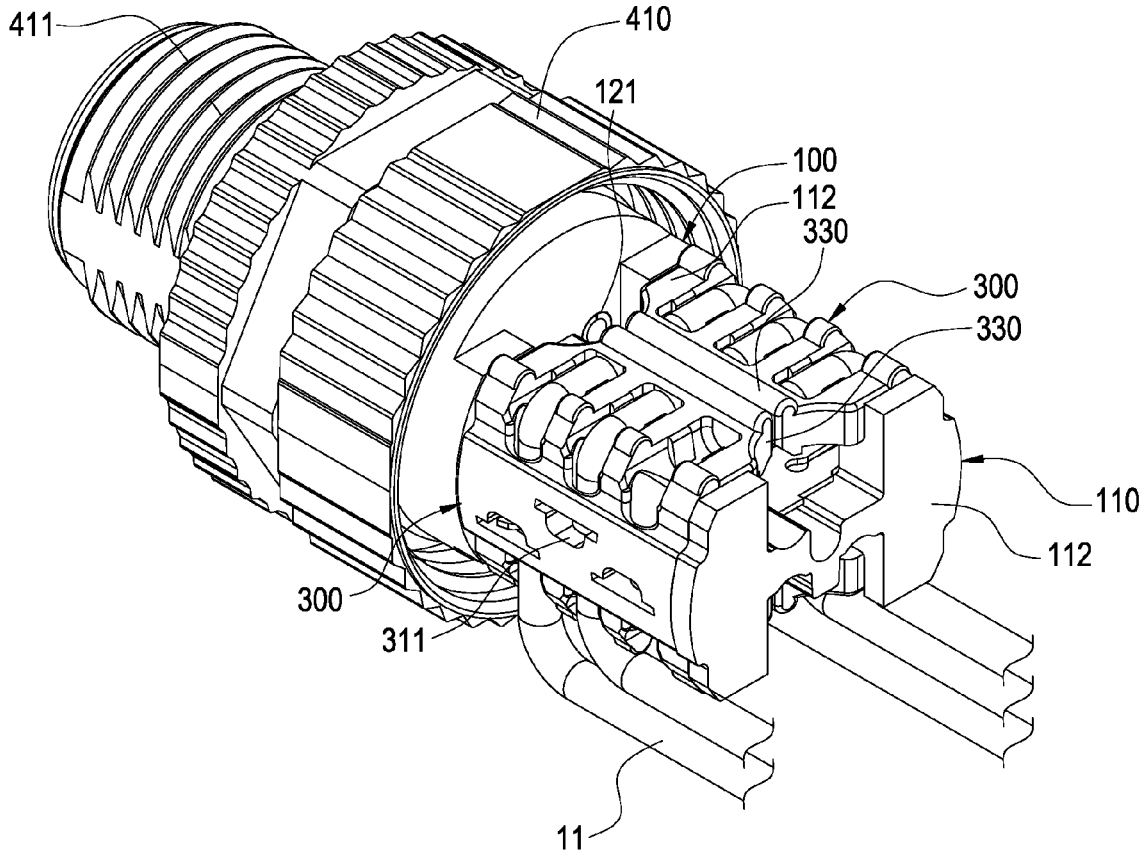
FIG. 8 is a schematic diagram showing the electrical connector coupled with cables.
Figure 9:
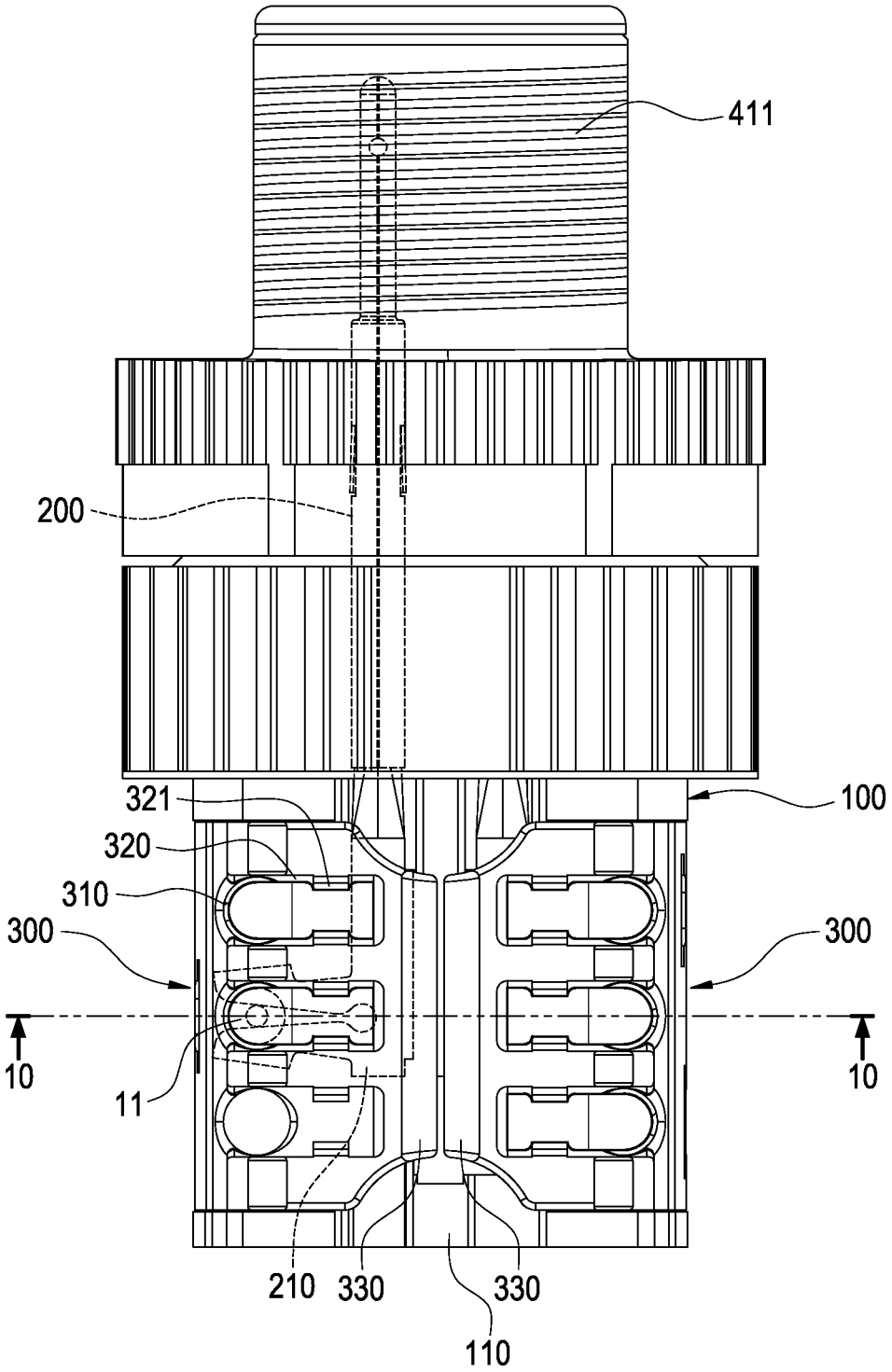
FIG. 9 is another schematic diagram showing the electrical connector coupled with cables.
Figure 10:
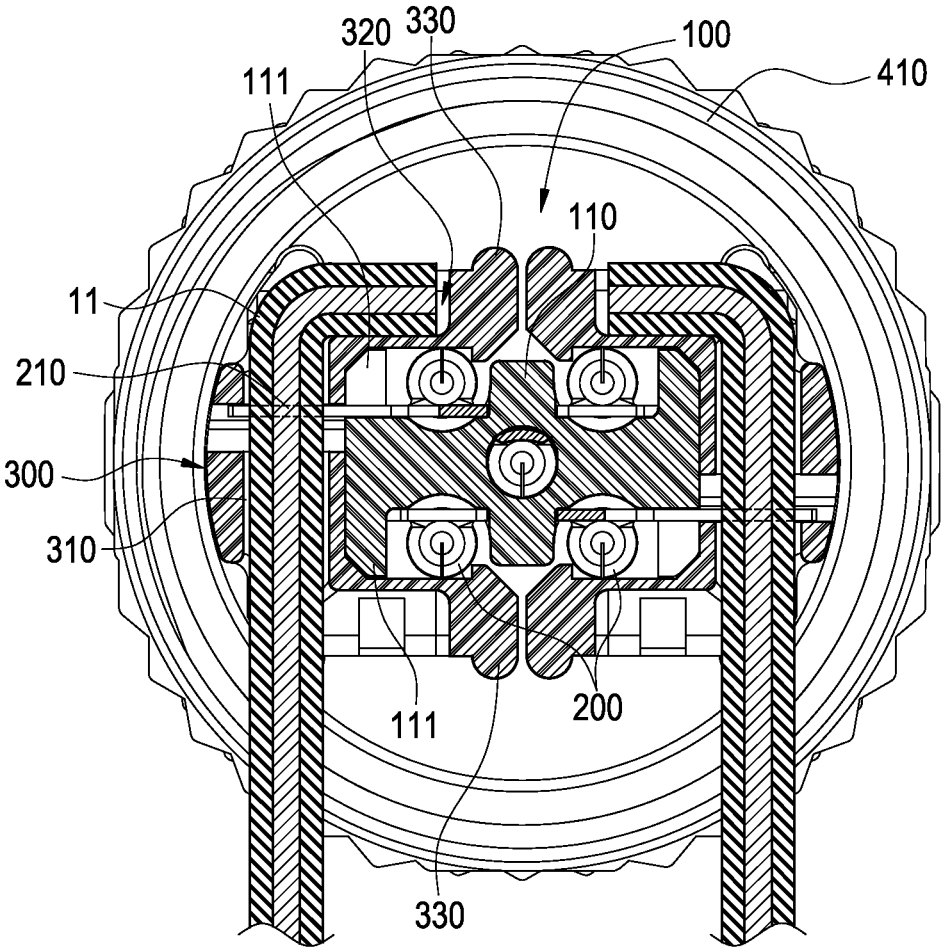
FIG. 10 is a sectional view of the electrical connector shown in FIG. 9.

Please refer to FIG. 8-10. The cable arranging base 300 are pulled to close with each other, each puncturing tool 210 is inserted in the corresponding insertion slot 310, and an end of the puncturing tool 210 is accommodated in the pocket hole 311 in the insertion slot 310. Thereby, an insulation skin of the conductive wire 11 in each insertion slot 310 is punctured by the puncturing tool 210 inserted in the insertion slot 310, and the conductive wire 11 is clipped by the puncturing tool 210. Therefore, each terminal 200 is electrically connected to the corresponding conductive wire 11 via the puncturing tool 210 thereof. Then, the first housing 410 is screw to the second housing 420.

In the present embodiment, an operator can check each conductive wire 11 and the terminal 200 electrically connected therewith via the cable clipping slots 320. If conductive wires 11 with various colors are provided, the operator can understand the connecting states thereby.

Each conductive wire 11 can be clipped and pressed into the cable connecting base 110 by the cable arranging base 300. Thereby, each conductive wire 11 can be easily electrically connected to the corresponding terminal 200.

Although the present disclosure has been described with reference to the foregoing preferred embodiment, it will be understood that the disclosure is not limited to the details thereof. Various equivalent variations and modifications can still occur to those skilled in this art in view of the teachings of the present disclosure. Thus, all such variations and equivalent modifications are also embraced within the scope of the present disclosure as defined in the appended claims.

What is claimed is:

1. An electrical connector comprising, an insulating pillar (100) having a cable connecting base (110) at an end of the insulating pillar (100);

a plurality of terminals (200) embedded in the insulating pillar (100), a puncturing tool (210) being provided at an end of each terminal (200), the puncturing tool (210) being extended from the cable connecting base (110) along a radial direction of the insulating pillar (100), and the puncturing tool (210) having a puncturing pin protruding out of the insulating pillar (100); and a pair of cable arranging bases (300) clipping on the cable connecting base (110) from two sides along the radial direction, respectively, and each having a plurality of insertion slots (310) corresponding to the puncturing tools (210), and each insertion slot (310) being formed along a direction perpendicular with a protruding direction of the corresponding puncturing pin, wherein a pocket through hole (311) is defined in the insertion slot (310) and formed on an outer surface of the cable arranging base (300), and allowed the puncturing tool (210) to be inserted therein;

wherein a cable clipping slot (320) corresponding to each insertion slot (310) is formed on the outer surface of the cable arranging base (300) for locating a distal end of one of a plurality of conductive wires (11) of a cable (10).

2. The electrical connector according to claim 1, wherein a couple of clipping blocks (321) are provided on an internal wall of each cable clipping slot (320).

3. The electrical connector according to claim 1, wherein a couple of stopping ribs (111) opposite to each other are provided on the cable connecting base (110), a couple of hooks (330) opposite to each other are provided on the cable arranging base (300), and each hook is hooked with the corresponding stopping ribs (111).

4. The electrical connector according to claim 1, wherein two limiting walls (112) opposite with each other are provided on the cable connecting base (110), the limiting walls (112) are arranged at interval, and the pair of cable arranging bases (300) is limited between the two limiting walls (112).

5. The electrical connector according to claim 1, wherein a plug (120) is formed at the other end of the insulating pillar (100), a plurality of hole slots (121) corresponding to the terminals (200) are defined on the plug (120) along an axial direction of the plug (120), the other end of each terminal (200) is inserted in the corresponding hole slots (121).

6. The electrical connector according to claim 1, further comprising a cylinder housing (400), the insulating pillar (100) being covered by the cylinder housing (400), and a tread (411) being provided on a lateral surface of an end of the cylinder housing (400).

7. The electrical connector according to claim 6, wherein the cylinder housing (400) comprises a first housing (410) and a second housing (420) hermitically coupled with each other, the plug (120) is covered by the first housing (410), and the cable connecting base (110) is covered by the second housing (420).

8. The electrical connector according to claim 7, wherein the tread (411) is provided on an external surface of the first housing (410).

9. The electrical connector according to claim 7, wherein a cable connection opening (421) is defined on the second housing (420).

* * * * *